US007131535B2

(12) United States Patent
Hernandez, Jr. et al.

(10) Patent No.: US 7,131,535 B2
(45) Date of Patent: Nov. 7, 2006

(54) APPARATUS FOR DISPLAYING TOOLS & MERCHANDISING METHOD

(75) Inventors: Hector Ray Hernandez, Jr., Fullerton, CA (US); Vincent S. Romeo, Corona, CA (US)

(73) Assignee: Alltrade Tools LLC, Long Beach, CA (US)

( * ) Notice: Subject to any disclaimer, the term of this patent is extended or adjusted under 35 U.S.C. 154(b) by 4 days.

(21) Appl. No.: 11/014,569

(22) Filed: Dec. 16, 2004

(65) Prior Publication Data

US 2005/0098462 A1 May 12, 2005

Related U.S. Application Data

(62) Division of application No. 10/327,376, filed on Dec. 20, 2002, now Pat. No. 6,966,165.

(51) Int. Cl.
*A45C 11/26* (2006.01)
*B65D 85/28* (2006.01)

(52) U.S. Cl. ..... 206/349; 206/372; 206/376; 206/477; 206/483; 211/70.6

(58) Field of Classification Search ..... 206/349, 206/461, 372–376, 477, 478, 480, 495; 211/70.6; D9/415, 722; 248/309.1
See application file for complete search history.

(56) References Cited

U.S. PATENT DOCUMENTS

| | | | | |
|---|---|---|---|---|
| 1,765,496 | A * | 6/1930 | Miller | 248/174 |
| 2,068,308 | A * | 1/1937 | Zerver | 206/376 |
| 5,036,975 | A * | 8/1991 | Chow | 206/376 |
| 5,996,817 | A * | 12/1999 | Kao | 211/70.6 |
| 6,547,077 | B1 * | 4/2003 | Budert | 206/754 |

* cited by examiner

*Primary Examiner*—David T. Fidei
(74) *Attorney, Agent, or Firm*—John J. Connors; Connors & Assoc. Inc.

(57) ABSTRACT

A method and device is disclosed for displaying a plurality of tools on a point-of-sale display. The device may comprises a pair of support members, each retaining a tool such that one tool partially obscures the other while allowing a customer to properly identify each tool.

9 Claims, 8 Drawing Sheets

APPARATUS FOR DISPLAYING TOOLS & MERCHANDISING METHOD

RELATED PATENT APPLICATIONS & INCORPORATION BY REFERENCE

This application is a divisional application of U.S. Ser. No. 10/327,376, entitled "APPARATUS FOR DISPLAYING TOOLS & MERCHANDISING METHOD," filed Dec. 20, 2002 now U.S. Pat. No. 6,966,165. This related application is incorporated herein by reference and made a part of this application.

DEFINITIONS

The words "comprising," "having," and "including," and other forms thereof, are intended to be equivalent in meaning and be open ended in that an item or items following any one of these words is not meant to be an exhaustive listing of such item or items, or meant to be limited to only the listed item or items.

The words "lateral movement" include both rotational movement and sideways movement.

BACKGROUND OF INVENTION

An assortment of methods are used to display tools for sale. One particular method comprises packaging a tool and then hanging the packaged tool onto a peg or hanger on a pegboard or other type of point-of-sale display. The packaged tool prominently displays a side of the tool such that a customer is able to easily identify the tool. Often, tools are sold together in combination. For example, screwdrivers having an assortment of sizes and head types may be sold as a set. Pliers are another example of tools that may be sold as a set.

Currently, packaged tools are displayed side-by-side. Hardware stores typically have a limited amount of shelf space or space available on a pegboard. Ideally, a hardware store would like to display as wide a variety of tools as possible in this limited amount of space. While tools displayed side-by-side are easily identifiable, it is not necessary for the entire side of a tool to be displayed to be properly identified by a customer. For example, a customer can identify a hammer by seeing just its head portion. A customer may not need to also see the handle to know it is a hammer.

SUMMARY OF INVENTION

This invention, with its several desirable features, is summarized in the CLAIMS that follow. After reading the following section entitled "DETAILED DESCRIPTION," one will understand how the features of this invention provide its benefits, which include, but are not limited to: displaying a plurality of tools at a point-of-sale while occupying a limited amount of display space, displaying the tools with one overlying the other to obscure only partially the underlying tool to enable the buyer to identify both tools by glancing momentarily at the display device of this invention holding these tools, and maintaining a vertical orientation of the tools in the display device while being displayed.

Some, but not all, of the features of the display device of this invention are:

One, the display device of this invention is adapted to be hung on a point-of-sale display, with the tools oriented substantially vertically. It includes a first support member adapted to retain a first tool when the device is hung on the point-of-sale display; and a second support member adapted to retain a second tool when the device is hung on the point-of-sale display. These support members are coupled together with the second support member overlying the first support member and are designed to hold tools of different shapes. When the tools are placed in the support members, one tool partially obscures the other tool. Each support member may include a body having at least one slot that allows a portion of a tool to be disposed therein. Each support member may have at least one wall and these walls may be spaced apart and substantially parallel.

Two, the display device may include a hanging member that is a plate typically having a substantially rectangular shape. The support members are fixedly mounted to the hanging member, with the overlying support member fixedly attached to the underlying member and the underlying member fixedly attached to the hanging member. The hanging member is adapted to hang the device on a point-of-sale display. The hanging member includes at least one arm extending from a display side of the hanging member. This arm is adapted to support a tool substantially vertically when the hanging member hangs the device on said point-of-sale display, preventing lateral movement.

In one embodiment, the hanging member includes a front side having at least one positioning element projecting outward therefrom. The first support member may be coupled by a snap-on type connector to the front side of the hanging member. This first support member includes a display side having at least one positioning element projecting outward therefrom and at least one slot in which a portion of a first tool is disposed therein. Upon assembly of the first tool, hanging member and first support member, the one positioning element engages the first tool and prevents any substantial lateral or other movement of the first tool while this portion of the first tool is in the first slot. In this one embodiment, the second support member is coupled by a snap-on type connector to the display side of the first support member and including at least one slot in which a portion of a second tool is disposed therein. Upon assembly of the second tool, hanging member and second support member, the one positioning element projecting from the display side of the first support member, engages the second tool and prevents any substantial lateral or movement of the second tool while the second tool is in the second slot.

This invention also includes a method of merchandising. According to this method, a pair of tools, or more are packaged together in a device point of sale display device with, for example, one tool overlying the other tool. One tool is held by a first support member and the other tool held by a second support member, and the support members are mounted to each other and each one prevent the tool supported thereby from moving laterally. The one tool overlying the other tool is sized so that it partially obscures said other underlying tool. The first and second support members orient the tools to hang substantially vertically when the device is hung a point-of-sale display. The device with the tools held in the overlying arrangement is hung at a point-of-sale display.

DESCRIPTION OF DRAWINGS

Some embodiments of this invention, illustrating all its features, will now be discussed in detail. These embodiments depict the novel and non-obvious display device and merchandising method of this invention as shown in the accompanying drawings, which are for illustrative purposes only. These drawings includes the following figures (Figs.), with like numerals indicating like parts.

DETAILED DESCRIPTION

Some Embodiments

Figure 1:
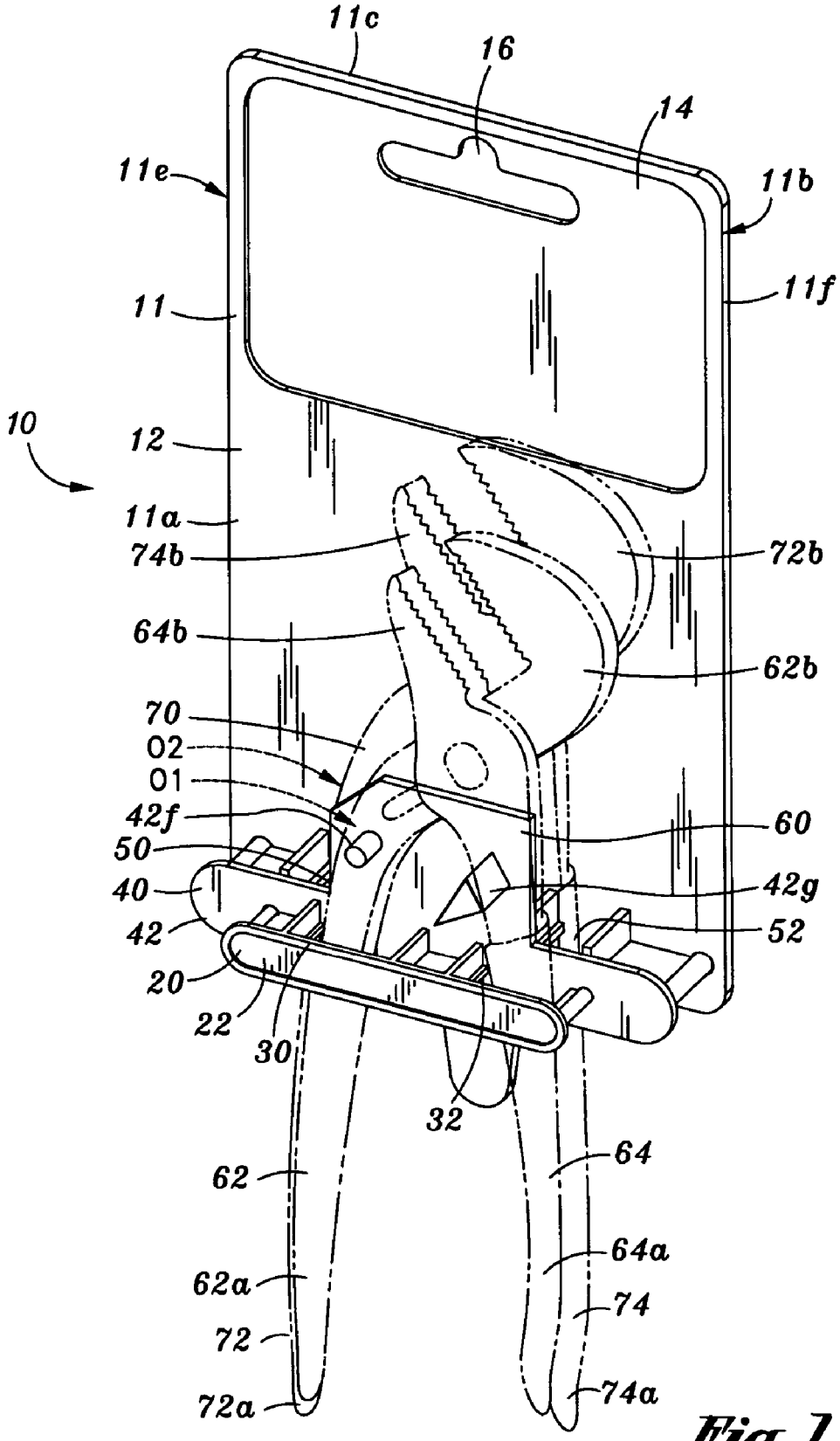
FIG. 1 is a perspective view of one embodiment of a display device of this invention, with a pair of coupled together slotted support members retaining two pairs of pliers shown in phantom lines.
Figure 5:
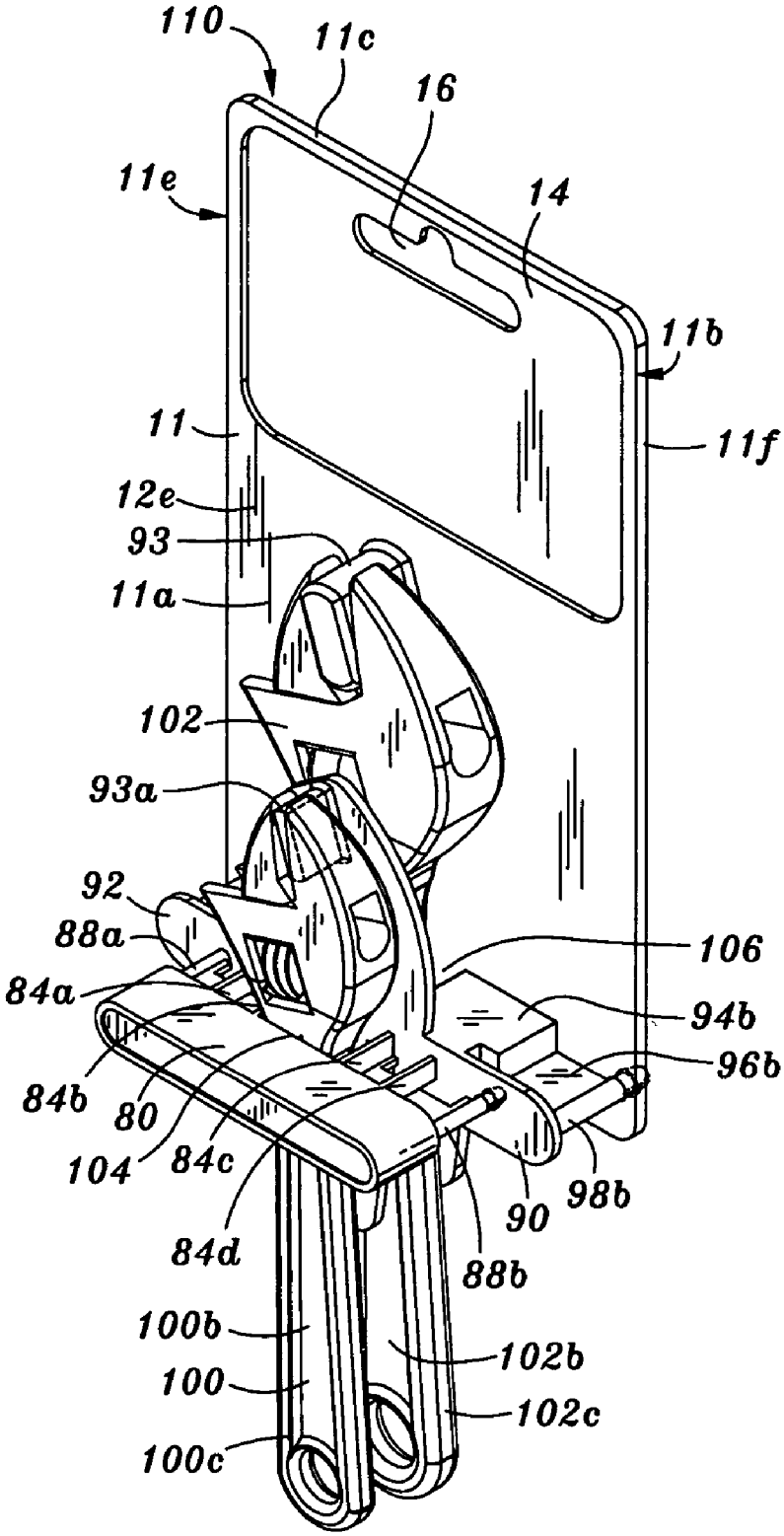
FIG. 5 is a perspective view of one embodiment of the display device, with a pair of coupled together single-slotted support members retaining two adjustable wrenches.

Referring particularly to FIGS. 1 & 5, there are two embodiments illustrated, display device 10 and the display device 110. Both devices 10 and 110 employ, respectively, hanging members 12 and 12*e* that are used to hang the device 10 or 110 onto a peg-board or other type of point-of-sale display (not shown). The hanging members 12 and 12*e* are substantially the same except for the configuration and number of positioning arm elements that project outward from the front side of the hanging members. The components of the devices 10 and 110, including the hanging members 12, may all be made separately from plastic such as, for example, polypropylene, and may be injected molded. These components are substantially rigid and designed to be snapped together to fasten these components to one another along with the tools being mounted on the display devices 10 or 110. The device 10 depicts mounting two pairs of pliers 60, 70 thereon, and the device 110 depicts mounting two adjustable wrenches 100, 102 thereon. Although the same types of pairs of tools are illustrated, two or more different types of tools may be mounted to the display device of this invention. For, example, a hammer and screwdriver may both be mounted to the display device of this invention.

Referring to FIGS. 1–4, the tool display device 10 generally comprises an inner support member 40, an outer support member 20, and the hanging member 12. The outer support member 20 may comprise an outer panel 22 having a front side 22*c*, a back side 22*d*, and opposed rounded or curved ends 22*a*, 22*b*, three spaced-apart, vertical walls 24*a*, 24*b*, 24*c* of substantially equal height that extend orthogonally/perpendicularly from the back side 22*d* of the outer panel 22, four adjoining, horizontal platforms 26*a*, 26*b*, 26*c*, 26*d* that extend orthogonally from the back side 22*d* of the outer panel 22, and a pair of locking connectors 28*a*, 28*b*. Each connector 28*a*, 28*b* extends orthogonally from the back side 22*d* of the outer panel 22 near one of the curved ends 22*a*, 22*b*, respectively. Both locking connectors 28*a* and 28*b* may have at one end a conically shaped split end insert 28*c* and 28*d*, respectively. Such connectors 28*a* and 28*b* are of the snap-on type that lock the outer support member 20 in position when the inserts 28*c* and 28*d* are inserted into a hole as subsequently discussed. Vertical walls 24*a*, 24*b*, and 24*c* and horizontal platforms 26*a*, 26*b*, 26*c*, 26*d* may be of equal depth and may act as a spacer, offsetting the outer panel 22 from the inner support member 40 upon snapping the connectors 28*a* and 28*b* into position.

Of the three vertical walls 24*a*, 24*b*, 24*c*, two of the vertical walls 24*b*, 24*c* may be located proximate to the center of the outer panel 22, while the wall 24*a* may lie near the curved end 22*a* and the wall 24*c* may lie near the curved end 22*b*. Of the four horizontal platforms, platforms 26*b* and 26*d* are both U-shaped and have substantially the same widths, and the platforms 26*a* and 26*c* are both rectangular and may be shorter in width than the platforms 26*b* and 26*d*. The platforms 26*a*, 26*d* may lie near the curved ends 22*a* and 22*b*, respectively, while the platform 26*c* may lie between two of the platforms 26*b* and 26*d*.

The inner support member 40 may comprise an inner panel 42 having a front 42*d*, a back side 42*e*, an extended portion 42*a*, a pair of curved ends 42*b*, 42*c*, four spaced-apart, vertical walls 44*a*, 44*b*, 44*c*, 44*d* of substantially equal height that extend orthogonally from the back side 42*e* of the inner panel 42, five adjoining, horizontal platforms 46*a*, 46*b*, 46*c*, 46*d*, 46*e* that may extend orthogonally from the back side 42*e* of the inner panel 42, and a pair of locking connectors 48*a* and 48*b*. Each connector 48*a*, 48*b* extends orthogonally from the back side 42*e* of the inner panel 42 near one of each of the curved ends 42*b* and 42*c*. Of the four vertical walls 44*a*, 44*b*, 44*c*, 44*d*, two of the vertical walls 44*b* and 44*c*, lie proximate to the center of the inner panel 42, while walls 44*a* and 44*d* each lie near the curved ends 42*b*, 42*c* of the inner panel 42, respectively. Of the five horizontal platforms 46*a*, 46*b*, 46*c*, 46*d*, 46*e*, three of the platforms 46*a*, 46*c* 46*e* may be of substantially the same width. The platforms 46*a*, 46*e* may lie near the curved ends 42*b*, 42*c*, respectively, while the platform 46*c* may lie between the platforms 46*b*, 46*d*. Both of the locking connectors 48*a*, 48*b* may have at one end, a conically shaped split end insert 48*c* and 48*d*, respectively. Such connectors 48*a* and 48*b* are of the snap-on type that lock the support member 40 in position when the inserts 48*c* and 48*d* are inserted into a hole as subsequently discussed. Vertical walls 44*a*, 44*b*, 44*c*, and 44*d* and horizontal platforms 46*a*, 46*c*, 46*e* are of equal depth and act as a spacer, offsetting the front 42*d* of the inner panel 42 from the hanging member 12 upon snapping the connectors 48*a* and 48*b* into position.

Positioning arms 42*f* and 42*g* extend orthogonally from the front 42*h* of the extended portion 42*a* of the inner support member 40. The arm 42*f* may be cylindrically shaped, or the arm 42*g* may be triangularly shaped. These arms 42*f* and 42*g* project outward to interact with and engage the pair of pliers 60, preventing lateral movement of the pair of pliers upon assembly of the support members 20 and 40 along with the pair of pliers 60.

Figure 2:
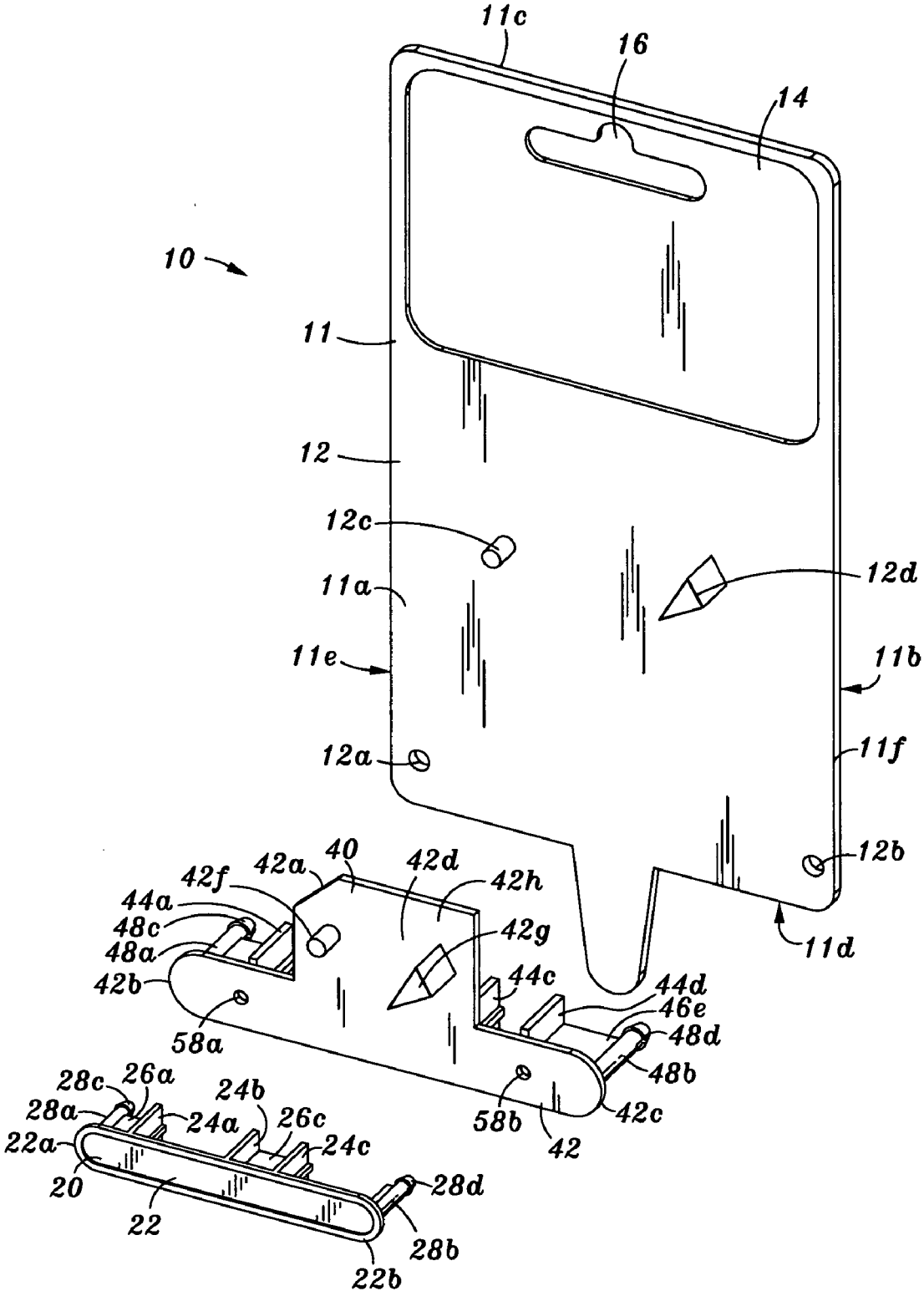
FIG. 2 is an exploded perspective view of the one embodiment of this invention shown in FIG. 1.
Figure 3:
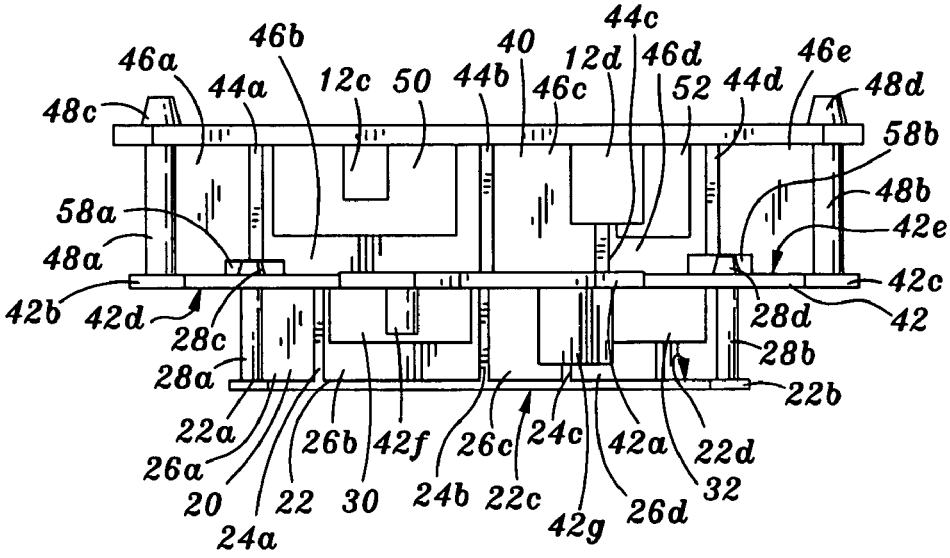
FIG. 3 is top plan view of the display device shown in FIG. 1.
Figure 4:
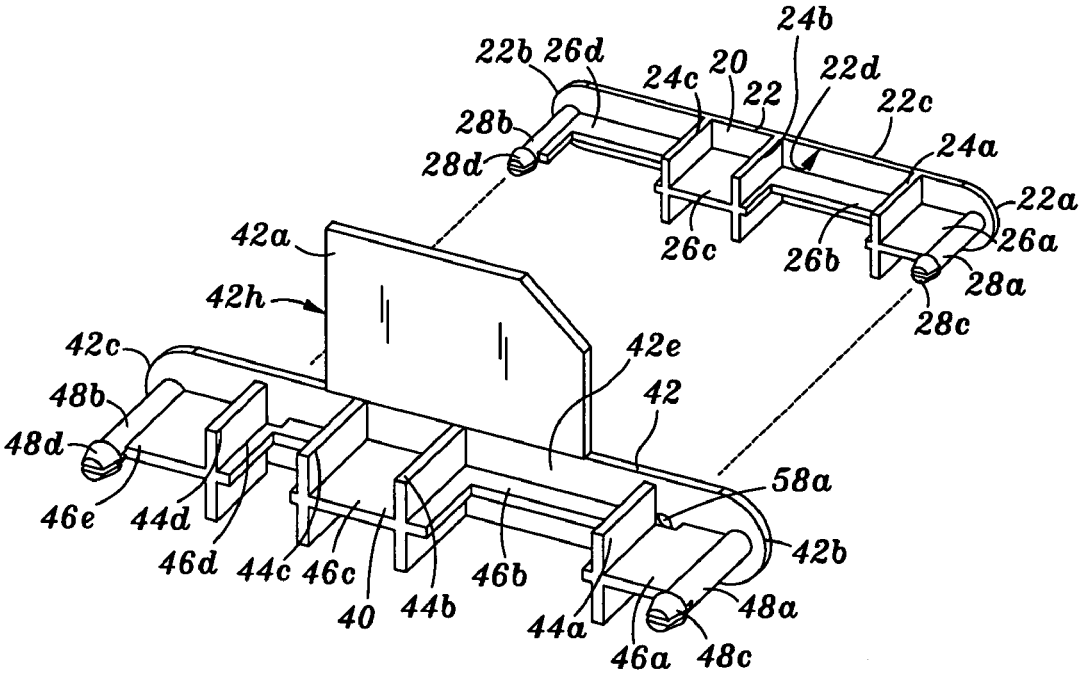
FIG. 4 is a rear perspective view of the pair of support members depicted in FIG. 1 decoupled from each other.

Referring to FIGS. 1 and 2, the hanging member 12 includes a rectangular, rigid plate 11, a rectangular recess 14, and a cutout 16. The rectangular recess 14 is located on the display side 11*a* of the rectangular plate 11. A label (not shown) of slightly smaller dimension than the recess 14 may be affixed within the recess 14. When affixed, the outer surface of the label may be substantially flush with the display side 11*a* surface of the rectangular plate 11. The rectangular plate 11 may have a display side 11*a*, a back side 11*b*, a top edge 11*c*, a bottom edge 11*d* and a pair of side edges 11*e* and 11*f*. A pair of holes 12*a* and 12*b* may be located along each side edge 11*e* and 11*f*, respectively, near the bottom edge 11*d*.

Positioning arms 12*c* and 12*d* may extend from the display side 11*a* of the rectangular plate 11, substantially midway between the top edge 11*c* and the bottom edge 11*d*, and spaced apart between side edges 11*e* and 11*f*. An arm 12*c* may be cylindrically shaped and the arm 12*d* may be triangularly shaped. The arms 12*c* and 12*d* are located in predetermined positions on the plate 11 so that they project outward to interact with and engage the pair of pliers 70, preventing lateral movement of the pair of pliers upon assembly of the support member 40 and the hanging member 12 along with the pair of pliers 70.

Referring to FIG. 1, two pairs of pliers 60 and 70 are simultaneously mounted to the device 10 as the components are assembled. Each pair of pliers 60 and 70 comprises a pair of levers 62, 64 and 72 and 74, respectively, pivotally joined together. Each lever 62, 64, 72 and 74 may comprise a handle end 62*a*, 64*a* and 72*a*, 74*a* and a jaw end 62*b*, 64*b* and 72*b*, 74*b*, respectively. The two pairs of pliers 60, 70 are attached to the device 10 so that the pair of pliers 60 overlies the pair of pliers 70. The one pair of pliers 70 is larger than the other pair of pliers 60. The smaller pair of pliers 60 has its handle ends 62*a* and 64*a* positioned respectively in slots 30 and 32 formed when the support members 20 and 40 are assembled together. The larger pair of pliers 70 has its handle ends 72*a* and 74*a* positioned respectively in slots 50 and 52 formed when the support member 40 and hanging member 12 are assembled together. The smaller pair of pliers 60 may be vertically supported by arms 42*f* and 42*g*. The larger pair of pliers 70 may also be vertically supported by the arms 12*c* and 12*d*.

When the device 10 is hung onto a point-of-sale display, such as by inserting a peg on a pegboard through cutout 16, the smaller pliers 60 is displayed in front of the larger pliers 70. The smaller pair of pliers 60 only partially obscures the larger pliers 70. In particular, the smaller pliers 60 allows a customer to see a large portion of the jaw end 72*b*, 74*b* of the larger pair of pliers 70, while substantially obscuring the handle end 72*a*, 74*a* of the larger pliers 70. A consumer looking at both pliers 60, 70 packaged by the device 10 is able to identify the larger pair 70 of pliers including its features such as jaw size 72*b*, 74*b* and arm length 72*a*, 74*a*.

Referring to FIG. 1, the two pairs of pliers 60, 70 are mounted to the device 10 so that the device must be destroyed, i. e. its components disassembled, to remove the two pairs of pliers from the device 10. This is an anti-theft measure. The components of the device 10 and the two pairs of pliers 60, 70 are assembled together as follows: First the pair of pliers 70 is attached by the support member 40 to the plate 11 by connecting this support member 40 to the plate 11 so that the arms 12*c* and 12*d* engage the pair of pliers 70. When connectors 48*a* and 48*b* of the inner support member 40 are inserted into the holes 12*a* and 12*b* of the hanging member 12, the horizontal platforms 46*a*, 46*b*, 46*c*, 46*d*, 46*e* and the rectangular plate 11 define a pair of spaced slots 50 and 52. The lever 72 of the pair of pliers 70 passes through the slot 50 and the lever 74 passes through the slot 52. Next, the pair of pliers 60 is supported between the support members 20 and 40 by connecting the support member 20 to the support member 40 so that the arms 42*f* and 42*g* engage the pair of pliers 60. When the locking connectors 28*a* and 28*b* of the outer support member 20 are inserted into the holes 58*a*, 58*b* of the inner support member 40, the horizontal platforms 26*a*, 26*b*, 26*c*, 26*d*, 26*e* and the inner panel 42 of the inner support member 40 define a pair of slots 30 and 32. The lever 62 of the pair of pliers 60 passes through the slot 30 and the lever 64 passes through the slot 32.

The outer support member 20 is coupled to the inner support member 40 by inserting inserts 28*a* and 28*b* into holes 58*a* and 58*b*. The vertical walls 24*a*, 24*b*, 24*c* and long horizontal platforms 26*a*, 26*c* and 26*e* of the outer support member 20 may contact the inner panel 42 of the inner support member 40. The vertical walls 24*a*, 24*b*, 24*c* and long horizontal platforms 26*a*, 26*c* and 26*e* may limit how deep the locking connectors 28*a* and 28*b* are inserted into the holes 58*a* and 58*b*. The inner support member 40 may be coupled to the hanging member 12 by inserting inserts 48*a* and 48*b* into holes 12*a* and 12*b*. The vertical walls 44*a*, 44*b*, 44*c*, 44*d* and horizontal platforms 46*a*, 46*c* 46*e* may limit how deep the locking connectors 48*a* and 48*b* are inserted into the holes 12*a* and 12*b*.

Upon assembly of the two pairs of pliers 60 and 70 and the components of the device 10, the cylindrical arms 12*c* and 42*f* respectively are seated in an oblong opening O1 and O2 in each pair of pliers 60 and 70, respectively. The triangular arms 12*d* and 42*g* respectively are bearing against and inner edges of the levers 74 and 64 of each of the pair of pliers 60 and 70. These arms 12*c*, 12*d* and 42*f*, 42*g* along with the slots 30, 32 and 50, 52 prevent lateral and vertical movement of the pair of pliers 60 and 70 while retained by the device 10. The device 10 must be bent to significantly distort its shape or some or all of the components disassembled to remove the pair of pliers 60 and 70 from the device 10. In another embodiment, the device 10 may be disassembled by separating the split-end inserts 28*c* and 28*d* from connectors 28*a* and 28*b*, separating the split-end inserts 48*c* and 48*d* from connectors 48*a* and 48*b*, pulling the outer support member 20 from the inner support member 40, and pulling the inner support member 40 from the hanging member 12.

Referring to FIGS. 5–9, the tool display device 110 generally comprises an inner support member 90, an outer support member 80, and the hanging member 12*e* that is used to hang the device 110 onto a point-of-sale display (not shown). The outer support member 80 may comprise an outer panel 82 having a front side 82*c*, a back side 82*d*, and a pair of curved ends 82*a*, 82*b*, four spaced-apart, vertical walls 84*a*, 84*b*, 84*c*, 84*d* of substantially equal depth that extend orthogonally from the back side 82*d* of the outer panel 22, five adjoining, horizontal platforms 86*a*, 86*b*, 86*c*, 86*d*, 86*e* that extend orthogonally from the back side 82*d* of the outer panel 82, and a pair of locking connectors 88*a*, 88*b*, each connector 88*a*, 88*b* extending orthogonally from the back side 82*d* of the outer panel 82 near one of the curved ends 82*a*, 82*b*, respectively. Of the four vertical walls 84*a*, 84*b*, 84*c*, 84*d*, two of the vertical walls 84*a* and 84*b* may be located proximate to curved sidewall 82*a* of the outer panel 82, while vertical walls 84*c* and 84*d* may lie near curved sidewall 82*b*. Of the five horizontal platforms, 86*a*, 86*b*, 86*c*, 86*d*, 86*e*, four of the platforms 86*a*, 86*b*, 86*d* and 86*e* may be of substantially similar depth, and platform 86*c*, may lie near the center of the outer panel 82. Both locking connectors 88*a* and 88*b* may have at one end, a conically shaped split end insert 88*c* and 88*d*, respectively. When the locking connectors 88*a* and 88*b* of the outer support member 80 are inserted into the holes 95*b* and 95*a* of the inner support member 90, the horizontal platforms 86*c*, 86*d* and the inner panel 92 of the inner support member 90 define a single slot 104.

The inner support member 90 comprises an inner panel 92 having a front side 92*d*, a back side 92*e*, an upper extended portion 92*a* and a lower extended portion 92*b*, and a pair of curved ends 92*b*, 92*c*, a pair of rectangularly shaped blocks 94*a* and 94*b* of substantially equal depth that extend orthogonally from the back side 92*e* of the inner panel 92, two horizontal platforms 96*a* and 96*b*, that may extend orthogonally from the back side 92*e* of the inner panel 92, and a pair of locking connectors 98*a* and 98*b*, each connector 98*a*, 98*b* extending orthogonally from the back side 92*e* of the inner panel 92 near one of each of the curved ends 92*b* and 92*c*. The two rectangular blocks 94*a* and 94*b* may lie near the middle of inner panel 92. The horizontal platforms 96*b* and 96*a* may be of substantially similar length and each may lie near the curved ends 92*b*, 92*c*, respectively. Both of the locking connectors 98*a*, 98*b* may have at one end, a conically shaped split end insert 98*c* and 98*d*, respectively. When connectors 98*a* and 98*b* of the inner support member 90 are inserted into holes 12*a* and 12*b* of the hanging member 12, the rectangular blocks 94*a* and 94*b* define a single slot 106. There is a pair of arms 93*a* and 97*a* projecting outward from the inner support member 90. One arm 93*a* is located on an upper extended portion 92*a* of the front side 92*d* of the inner panel 92, and the other arm 97*a* is located on a lower extended portion 92*b* of the front side 92*d* of the inner panel 92 Arm 93*a* may be rectangularly shaped, while arm 97*a* may be cylindrically shaped.

Figure 6:
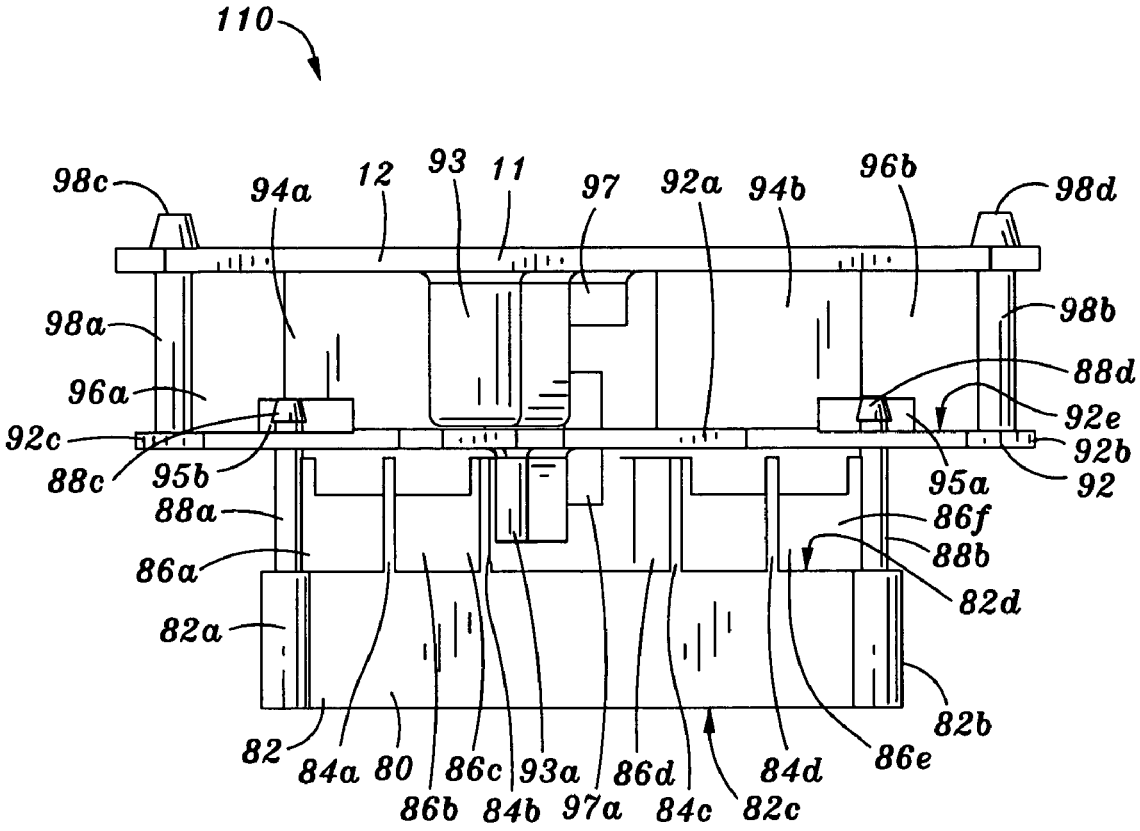
FIG. 6 is top plan view of the display device shown in FIG. 5 retaining two wrenches.
Figure 9:
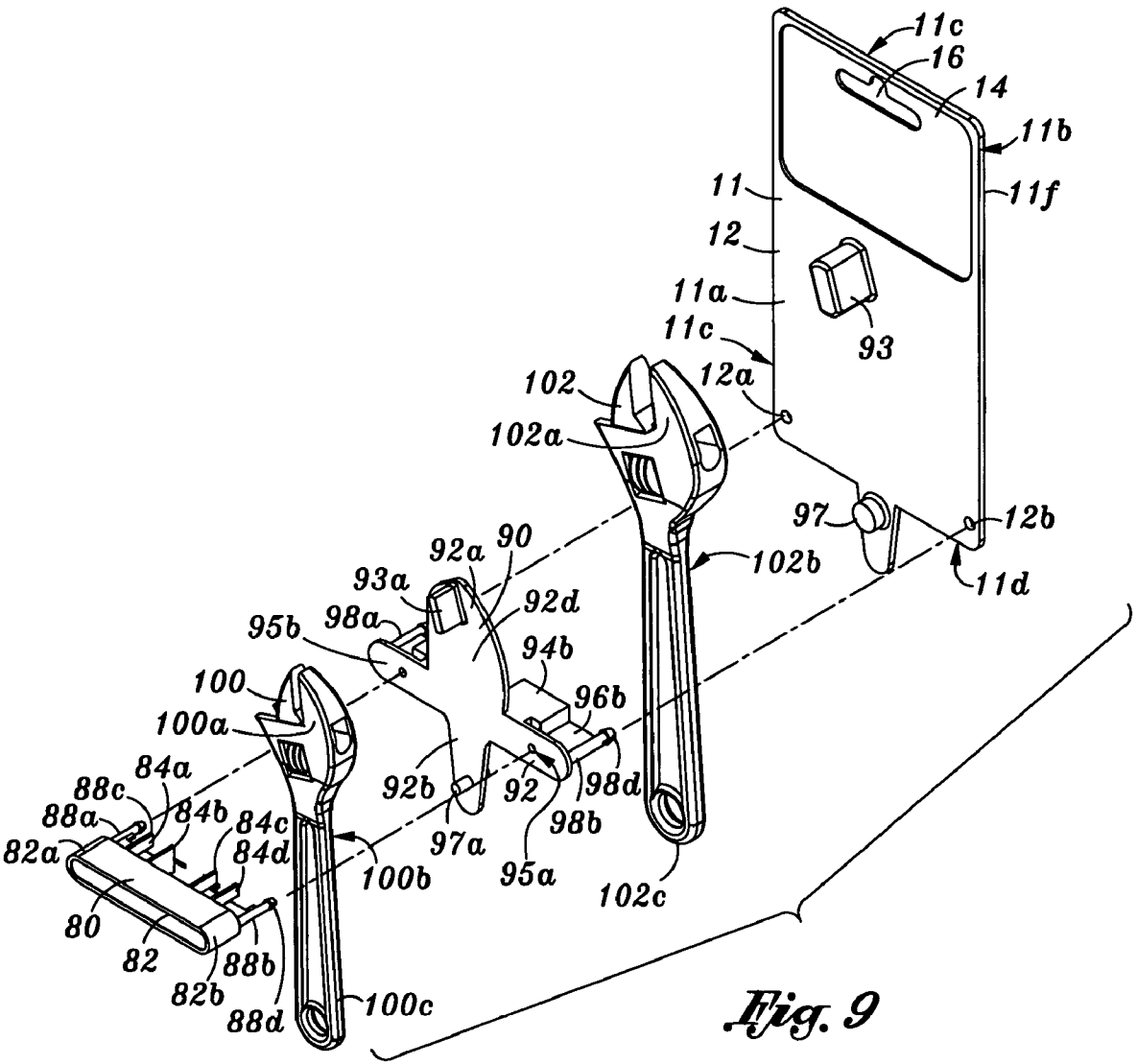
FIG. 9 an exploded front perspective view of the one embodiment shown in FIG. 5 retaining two adjustable wrenches.

Referring to FIG. 6 and 9, the hanging member 12 is substantially identical to the one used in connection with the embodiment shown in FIG. 1, except instead of the arms 12*c* and 12*d*, the arms 93 and 97 extend outward from the plate 11. The arms 93 and 97 are located in predetermined positions on the plate 11 so that they interact with and engage the wrench 102, preventing lateral movement of the wrench 102 upon assembly of the support members 80 and 90 along with the wrench 102. The outer support member 80 is coupled to the inner support member 90 by inserting inserts 88*a* and 88*b* into holes 95*b* and 95*a*, respectively. The vertical walls 84*a*, 84*b*, 84*c* and 84*d* of the outer support member 80 may contact the inner panel 92 of the inner support member 90. The vertical walls 84*a*, 84*b*, 84*c* and 84*d* and horizontal platforms 86*a*, 86*c*, 86*d* and 86*f* may limit how deep the locking connectors 88*a* and 88*b* are inserted into the holes 95*b* and 95*a*. The inner support member 90 may be coupled to the hanging member 12 by inserting inserts 98*a* and 98*b* into holes 12*a* and 12*b*. The rectangular blocks 94*a* and 94*b* limit how deep the locking connectors 98*a* and 98*b* are inserted into the holes 12*a* and 12*b*.

Figure 7:
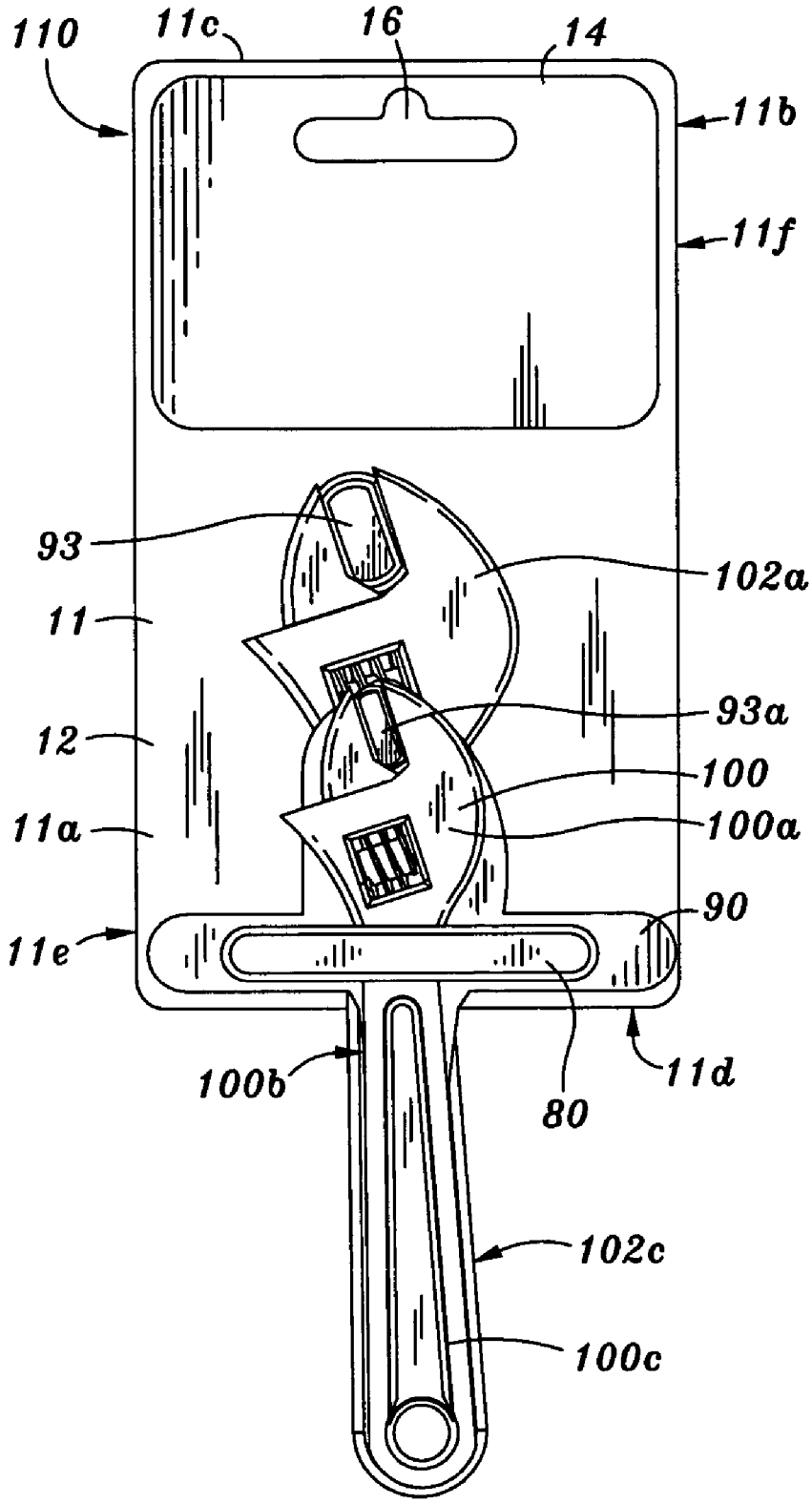
FIG. 7 front view of the one embodiment of the display device shown in FIG. 5
Figure 8:
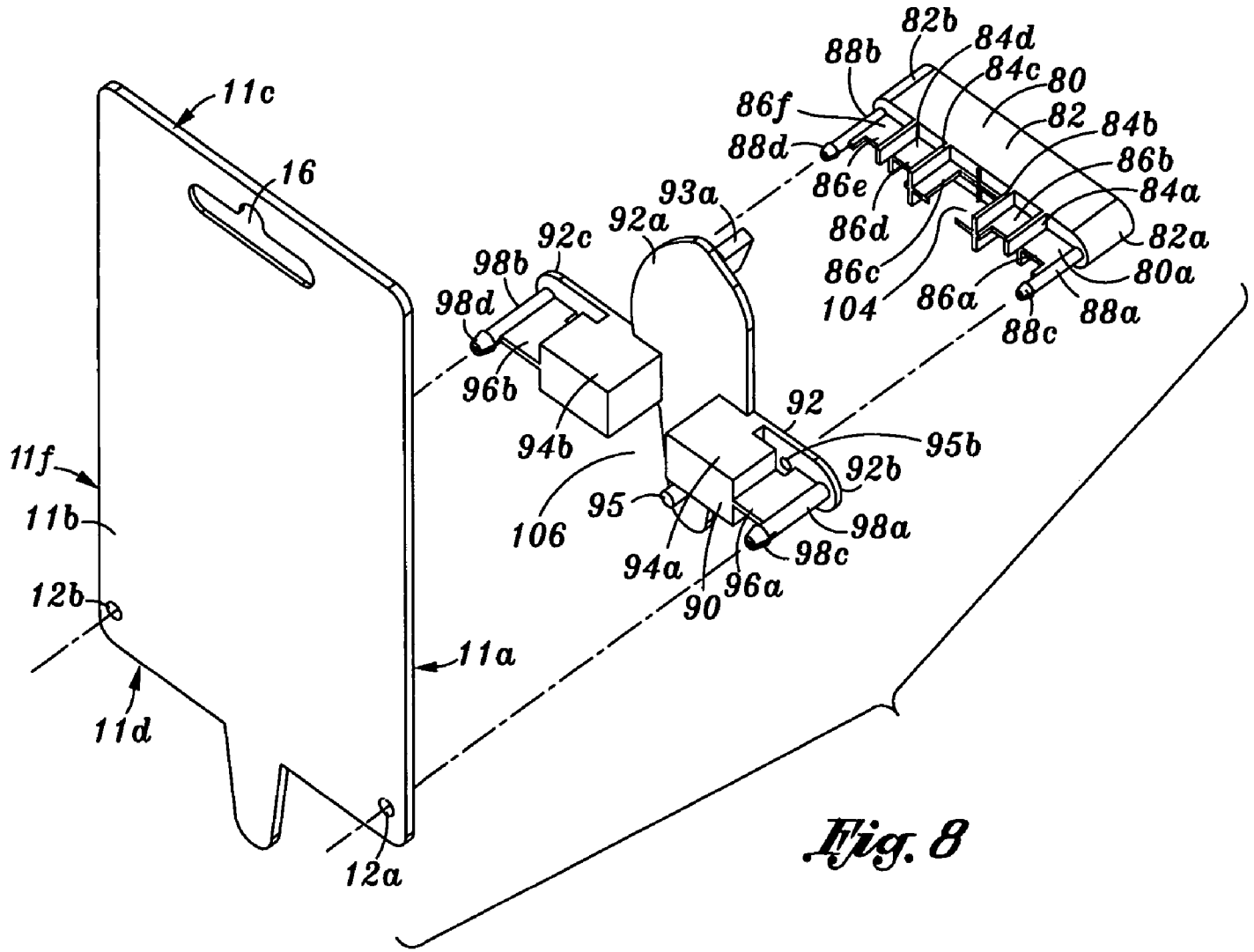
FIG. 8 is an exploded rear perspective view of the one embodiment shown in FIG. 5.

Referring to FIGS. 5, 7 and 9, the device 110 is designed to display two adjustable wrenches 100 and 102. Each wrench 100 and 102 generally comprises a clamp 100*a*, 102*a*, a handle 100*c*, 102*c* and an indention 100*b*, 102*b* (only the front indentation shown) on each side of their respective handles 100*c*, 102*c*. One adjustable wrench 102 may be larger than the other wrench 100. The smaller adjustable wrench 100 may be inserted into the outer support member 80 by placing the handle 100*c* through the slot 104. The larger adjustable wrench 102 may be inserted into the inner support member 90 by placing the handle 102*c* through slot 106. The smaller adjustable wrench 100 may be vertically and laterally supported by clamping the clamp 100*a* around the arm 93*a* and placing the positioning arm 97*a* into the indention 100*b* in the handle 100*c* of the wrench 100. The larger adjustable wrench 102 may be vertically supported by clamping the clamp 102*a* around arm 93 and placing the positioning arm 97*a* into the indention 102*b* in the handle 102 of the wrench 102.

The device 110 must be bent to significant distort its shape or some or all of the components disassembled to remove the pair of wrenches 100 and 102 from the device 110. In another embodiment, the device 110 may be disassembled by separating the split-end inserts 88*c* and 88*d* from connectors 88*a* and 88*b*, separating the split-end inserts 98*c* and 98*d* from connectors 98*a* and 98*b*, pulling the outer support member 80 from the inner support member 90, and pulling the inner support member 90 from the hanging member 12*e*.

When the device 110 is hung onto point-of-sale display, such as a peg on a pegboard, the smaller adjustable wrench 100 is displayed in front of the larger adjustable wrench 102. The smaller adjustable wrench 100 may partially obscure the larger adjustable wrench 102. In particular, the smaller adjustable wrench 100 may allow a customer to see a large portion of the clamp 102*a* of the larger adjustable wrench 102, while substantially obscuring the handle 102*c*. A consumer looking at the adjustable wrenches 100, 102 packaged by the device 110, shall be able to identify the larger adjustable wrench 102 as well as its features such as the size of its clamp 102*a* and the length of its handle 102.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

The invention claimed is:

1. A point-of-sale display device packaging first and second tools, comprising:

a rigid, plate type hanging member including a front side having at least one first positioning element projecting outward therefrom, a first support member coupled by a snap-on type connector to said front side of the hanging member, said first support member including a first wall element providing a front side having at least one second positioning element projecting outward therefrom and a second wall element that acts as a stop to offset the first wall element from the front side of the hanging member and forms a slot into which the first tool at least partially extends, with the first positioning element engaging said first tool and preventing any substantial lateral movement of the first tool while said portion of the first tool is in said first slot, said first wall element of the first support member being substantially parallel to the front side of the hanging member, and a second support member coupled by a snap-on type connector to said front side of the first wall element of said first support member and including a first wall element providing a front side and a second wall element that acts as a stop to offset the first wall element of the second support member from the front side of the first wall of the first support member and forms a second slot into which the second tool at least partially extends, with the second positioning element engaging said second tool and preventing any substantial lateral movement of the second tool while said portion of the second tool is in said second slot, said first wall element of the second support member being substantially parallel to the front side of the first wall member of the first support member.

2. A point-of-sale display device packaging first and second tools where the second tool is of a smaller size than the first tool, said device comprising:

a substantially rigid plate adapted to be hung vertically and including a front side, a first support member fixedly attached to said front side of the plate and having a display side and a first slot into which the first tool at least partially extends and is oriented substantially vertically when the plate is hung vertically, a second support member fixedly attached to the display side of the first support member and including a second slot into which the second tool at least partially extends and is oriented substantially vertically when the plate is hung vertically, a first positioning element engaging said first tool and preventing substantial lateral movement of the first tool while in said first slot, and a second positioning element engaging said second tool and preventing substantial lateral movement of the second tool while in said second slot, said slots positioned with respect to each other so the second tool overlies the first tool to obscure partially said first tool while both tools face outwardly in essentially the same direction to enable a buyer to identify both tools by glancing momentarily at the display device.

3. The device of claim 2 where said plate includes a third positioning element extending from the front side that supports the first tool substantially vertically when the plate member is hanging vertically on a point-of-sale display, and the first support member includes a fourth positioning element extending form the display side that supports the second tool substantially vertically when the plate member is hanging vertically on a point-of-sale display.

4. The device of claim 2 where said first support member is fixedly attached by a snap-on type connector to said front side of the plate and the second support member is fixedly attached by a snap-on type connector to said display side of the first support member.

5. The device of claim 2 where said display side of the first support member includes a first wall and the second support member has a second wall including a front side, said first wall being spaced apart from the front side of the plate to form the slot in the first support member and the second wall being spaced apart from the display side of the first support member to form the slot in the second support member.

6. The device of claim 5 where said first and second walls are substantially parallel.

7. A point-of-sale display device packaging first and second tools where the second tool is of a smaller size than the first tool, said device comprising:

a hanging member carrying the first and second tools and adapted to be hung in a substantially vertical orientation, a first support member having a display side and a second support member having a front side, said first and second support members being mounted to the hanging member with the second support member overlying the first support member and said first support member being fixedly attached to the front side of the hanging member and said second support member being fixedly attached to the display side of the first support member, said first and second support members each including at least one slot therein with the first tool at least partially lodged in the slot in the first support member and being oriented substantially vertically when the hanging member is hung vertically and the second tool at least partially lodged in the slot in the second support member and being oriented substantially vertically when the hanging member is hung vertically, said front side of the hanging member and the display side of the first support member and the front side of the second support member being substantially parallel to each other, and said display side of the first support member at least partially covering the front side of the hanging member and said front side of the second support member at least partially covering the display side of the first support member, a pair of positioning elements, one positioning element engaging the first tool and preventing substantial lateral movement of the first tool while the hanging member is hung in a substantially vertical orientation and the other positioning element engaging the second tool and preventing substantial lateral movement of the second tool while the hanging member is hung in a substantially vertical orientation, said first and second support members being positioned with respect to each other so the second tool overlies the first tool to obscure partially said first tool while both tools face outwardly in essentially the same direction to enable a buyer to identify both tools by glancing momentarily at the display device.

8. The device of claim 7 where said first and second support members are attached by a snap-on type connector.

9. A point-of-sale display device packaging first and second tools where the second tool is of a smaller size than the first tool, said device comprising:

a hanging member adapted to be hung in a substantially vertical orientation and including a front side, first and second support members fixedly mounted to the hanging member by snap-on type connectors, with the second support member overlying the first support member and fixedly attached by a snap-on type connector to a display side of the underlying first support member and the first support member fixedly attached by a snap-on type connector to the front side of the hanging member, a first pair of positioning elements engaging said first tool and preventing substantial lateral and vertical movement of the first tool while in a first slot, and a second pair of positioning elements engaging said second tool and preventing substantial lateral and vertical movement of the second tool while in a second slot, said slots positioned with respect to each other so the second tool overlies the first tool to obscure partially said first tool while both tools face outwardly in essentially the same direction to enable a buyer to identify both tools by glancing momentarily at the display device.

* * * * *